US005328110A

United States Patent [19]

Wirtz et al.

[11] Patent Number: 5,328,110

[45] Date of Patent: Jul. 12, 1994

[54] AUTOMATIC MULTI-STATION TEXTILE STRAND HANDLING MACHINE

[75] Inventors: Ulrich Wirtz; Helmuth Hensen, both of Monchengladbach; Helmut Kohlen, Erkelenz; Paul Surkamp, Kempen; Hans Grecksch; Dietmar Engelhardt, both of Monchengladbach, all of Fed. Rep. of Germany

[73] Assignee: W. Schlafhorst AG & Co., Moenchengladbach, Fed. Rep. of Germany

[21] Appl. No.: 96,641

[22] Filed: Jul. 21, 1993

Related U.S. Application Data

[63] Continuation of Ser. No. 679,629, Apr. 3, 1991, abandoned.

[30] Foreign Application Priority Data

Apr. 6, 1990 [DE] Fed. Rep. of Germany ..... 4011220

[51] Int. Cl.[5] ..... B65H 54/00; D01H 9/14

[52] U.S. Cl. ..... 242/18 R; 57/281

[58] Field of Search ..... 242/18 R, 35.5 A, 35.6 E, 242/35.5 R; 57/92, 100, 1 R, 281, 112

[56] References Cited

U.S. PATENT DOCUMENTS

| | | | |
|---|---|---|---|
| 3,774,859 | 11/1973 | Brouwer et al. | 242/35.5 A X |
| 3,906,712 | 9/1975 | Miyazaki et al. | 242/35.5 A X |
| 4,255,925 | 3/1981 | Marzoli et al. | 57/304 |
| 4,518,136 | 5/1985 | Rohner | 242/35.5 A |
| 4,576,340 | 3/1986 | Aretz et al. | 242/35.6 E X |
| 4,606,509 | 8/1986 | Hiroaki | 242/35.6 E X |
| 4,634,066 | 1/1987 | Matsui et al. | 242/35.5 A |
| 4,681,271 | 7/1987 | Matsui et al. | 242/35.5 R X |
| 4,723,720 | 2/1988 | Matsui et al. | 242/35.6 E X |
| 4,723,885 | 7/1988 | Grube et al. | 242/35.5 A X |
| 4,729,709 | 3/1988 | Raasch | 242/35.5 A X |
| 4,809,919 | 3/1989 | Ueda et al. | 242/35.5 A X |
| 4,848,076 | 7/1989 | Ueda et al. | 57/281 |
| 4,856,723 | 8/1989 | Tone | 242/35.5 A X |
| 4,964,269 | 10/1990 | Dinklemann | 57/281 |
| 5,092,116 | 3/1992 | Kawasaki et al. | 57/281 |

FOREIGN PATENT DOCUMENTS

| | | |
|---|---|---|
| 052915814 | 10/1979 | Fed. Rep. of Germany . |
| 3431790A1 | 3/1985 | Fed. Rep. of Germany . |
| 3802900A1 | 8/1988 | Fed. Rep. of Germany . |

*Primary Examiner*—Daniel P. Stodola
*Assistant Examiner*—Michael R. Mansen
*Attorney, Agent, or Firm*—Shefte, Pinckney & Sawyer

[57] ABSTRACT

A multistation automatic textile machine, such as a multi-position winder or spinning machine, having a passageway formed through the machine's end frame structure for accommodating a transport conveyor or other transport path for spinning bobbins and other strand-supporting tubes.

8 Claims, 2 Drawing Sheets

AUTOMATIC MULTI-STATION TEXTILE STRAND HANDLING MACHINE

This is a continuation of co-pending application Ser. No. 07/679,629, filed apr. 3, 1991, now abandoned.

BACKGROUND OF THE INVENTION

The present invention relates generally to automatic textile machines of the type having a plurality of work stations arranged adjacent one another, each station being adapted for processing or otherwise handling a yarn, roving or other textile strand, e.g., multi-station textile yarn winding machines, textile yarn spinning machines, and the like.

In automatic multi-station textile machines of the aforementioned type, it is typical to provide each work station with only the operational components necessary for performing the particular strand processing or handling functions to be carried out in identical manner at each work station, with the work station components being operatively connected to common supply components extending to centralized supply devices housed within frame structures at one or both ends of the machine.

It is also typical to provide a conveyor or like transport system for delivering strand packages such as textile bobbins to and from the work stations, such transport systems generally also including centralized devices for performing a processing step on, or otherwise handling of, the bobbins or other packages.

Thus, it is known that the floor space required for such textile machines in textile mills must be sufficient to accommodate the multiple work stations of the machine and the machine's end frames, as well as the associated bobbin or package transport system. Since the floor area requirement for a given textile machine directly determines the total number of such machines which can be accommodated within a given building size or within a given amount of available floor space, a reduction of the floor space a machine requires can provide the significant advantage of enabling a greater number of machines to be operated within the same floor area. Likewise, in the design and planning of new construction of textile manufacturing buildings, a reduction in the floor space a machine requires can enable a corresponding reduction in the size and cost of the building.

SUMMARY OF THE INVENTION

It is accordingly an object of the present invention to provide a multi-station automatic textile strand handling machine of the aforementioned type which occupies a lesser area of floor space than a comparable conventional multi-station textile machine while still providing all of the same structural components and functions.

Basically, the present invention is applicable to virtually any automatic textile strand handling machine of the type having a plurality of work stations arranged adjacent one another, means for transporting strand bobbins relative to the work stations, and frame means at one end of the work stations wherein common supply means for all of the work stations is supported. According to the present invention, the end frame means in such machine includes means defining at least one passageway through the end frame means for transport of strand bobbins.

The provision of one or more passageways for transport of strand bobbins through, rather than around, the end frame means of the textile machine, enables the present machine to utilize the same floor space occupied by the end frame for housing the common work station supply means as well as for defining one or more transport paths of the transport system for the strand bobbins.

In the preferred embodiment of the present invention, the passageway defining means of the end frame means includes a base portion which defines an upper limit of the bobbin passageway sufficient to accommodate unrestricted transport therethrough of strand bobbins. Preferably, at least one bobbin handling device or means is arranged in association with the end frame means for operation on strand bobbins transported through the passageway or passageways. In this manner, the passageway may be configured and dimensioned to permit relatively free access to the path of bobbin transport through the passageway or passageways as well as, optionally, to the bobbin handling devices or means.

The present invention may be embodied with particular advantage in a bobbin winding machine wherein wound and empty yarn-carrying tubes are independently transported to and from the yarn winding stations by means of individual tube carriers, such as so-called peg trays or pallets having a flat, usually circular, horizontal base with an axially upstanding support pin for mounting thereon of a yarn tube. Typical transport systems utilized in such bobbin winding machines include main and secondary transport paths, and may also include auxiliary or "backup" transport sections for tubes awaiting a vacancy at one of the winding stations for delivery thereto. Processing or handling devices for operating on the transported yarn tubes, such as a tube cleaning device and/or a yarn end preparation device, may be provided along the secondary transport path. In the present invention, the secondary transport path, including a tube cleaning device, a yarn end preparation device, and/or another tube processing or handling device, as well as the backup extent of the transport system, can conveniently be housed almost entirely under the end frame means. As a result, a considerable shortening of the overall length of the winding machine can be realized without increasing its width.

DESCRIPTION OF THE PREFERRED EMBODIMENT

Figure 1:
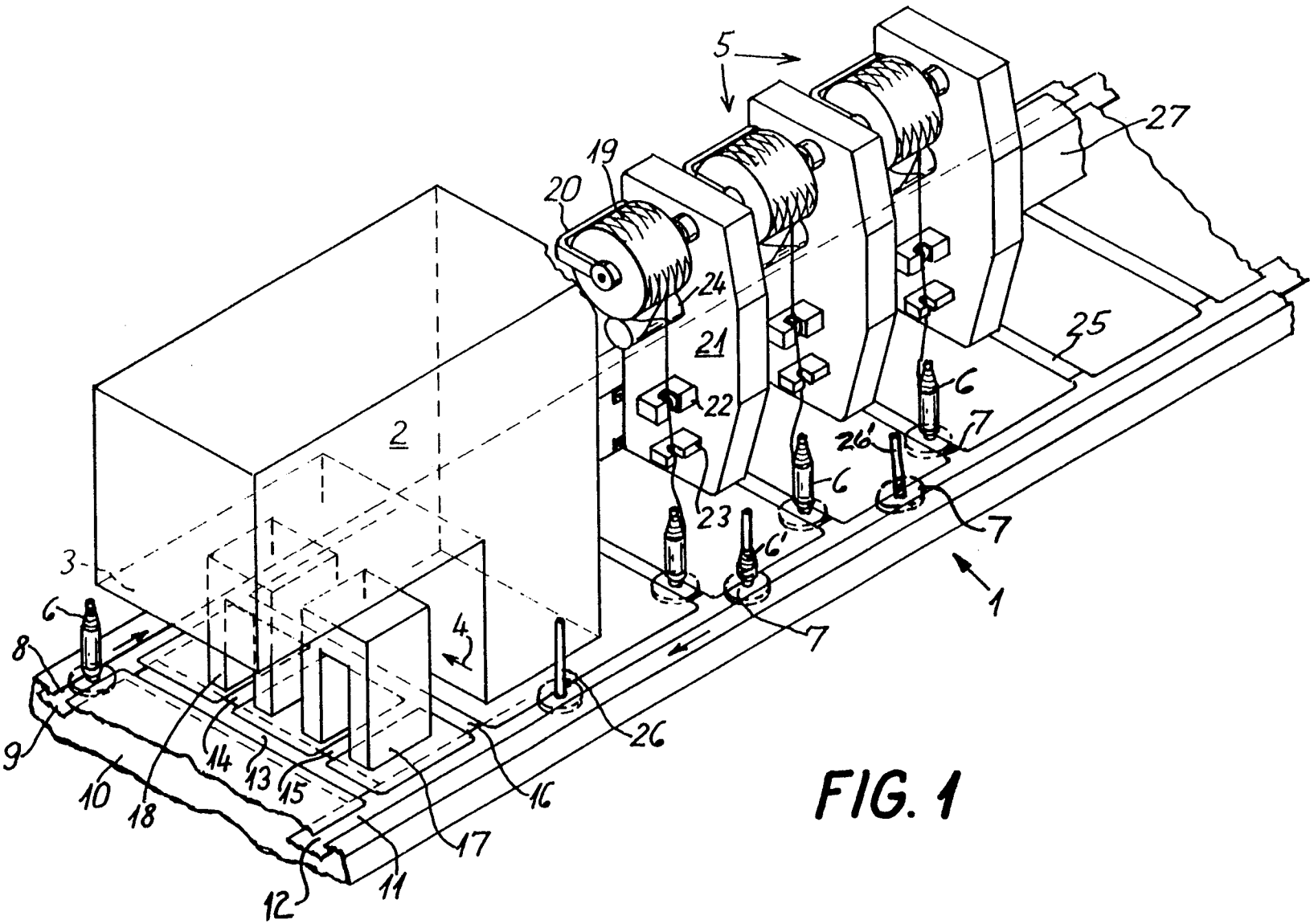
FIG. 1 is a perspective view of an automatic multistation textile bobbin winding machine having a transport system for carrier-supported wound and empty yarn tubes, according to one preferred embodiment of the present invention.

Referring now to the accompanying drawings and initially to FIG. 1, an automatic bobbin winding machine is indicated generally at 1 and basically includes a plurality of winding stations or heads in adjacent alignment with one another along the length of the machine. Fully-wound yarn tubes 6 are transported to the winding stations 5 for yarn unwinding therefrom and empty yarn tubes 26 are transported away from the winding stations 5 after yarn unwinding by means of individual tube-supporting carriers 7, preferably of the conventional peg tray or pallet type, along a transport system, more fully described hereinafter, which defines main transport paths 8,11, extending lengthwise along the respective opposite sides of the winding stations 5, with a plurality of main transverse transport paths 25 extending laterally between the main longitudinal transport paths 8,11 at each winding station 5, and secondary transport paths 13,14,15,16, arranged between the main longitudinal transport paths 8,11 at one end of the winding machine 1.

At each winding station 5, a fully-wound yarn tube 6 supported by its associated peg tray 7 is disposed for unwinding of yarn therefrom, as depicted in FIG. 1. Each winding station 5 includes a peripherally-grooved driven winding drum 24 for the combined purpose of frictionally surface driving a tubular yarn bobbin 19 supported by a creel assembly 20 and for simultaneously applying the yarn unwound from the tube 6 in a cross-wound fashion about the bobbin 19. The yarn unwound from the tube 6 is initially guided by a yarn brake 23 and an electronic yarn cleaner 22 in advance of the grooved drum 24. While those persons skilled in the art will recognize that winding stations of conventional bobbin winding machines also are equipped with other components, e.g., yarn splicing devices, such components are omitted from the illustration of FIG. 1 for sake of simplicity since the particular construction of the winding stations 5 does not form a part of the present invention.

The tube transport system of the winding machine 1 is preferably formed by a series of driven endless conveyor belts. More specifically, the transport path 8 extending lengthwise along one side of the winding machine is formed by an endless driven conveyor belt 9 for delivering peg trays 7 supporting fully-wound yarn tubes 6 to the several winding stations 5 of the bobbin winding machine 1 for unwinding. Another auxiliary transport path (not shown) may be provided in association with and parallel to the transport path 8 for receiving peg tray-supported wound tubes 6 from the transport path 8 and, in turn, supplying them to the individual transverse transport paths 25 associated with the multiple winding stations 5. This auxiliary transport path is preferably formed by a reversible conveyor belt by which peg trays 7 supporting wound cops 6 may be transported back and forth along the auxiliary transport path until one or more vacancies occur on one or more of the transport paths 25 which can then be occupied by the peg tray-mounted tube or tubes 6 on the reversing conveyor. Yarn end preparation devices (not shown) may be arranged along the transport path 8 or along a parallel transport extent (e.g., the reversing conveyor) under a suction traverse 27 for locating and preparing the leading yarn end on each wound yarn tube 6 in preparation for yarn unwinding at one of the winding stations 5. In this arrangement, these yarn end preparation devices do not increase the floor space occupied by the winding machine 1, in contrast to corresponding conventional winding machines. The transport path 11 is preferably formed by an endless conveyor belt 12 extending along the opposite side of the winding machine 1 from the conveyor belt 9 for receiving peg trays 7 supporting emptied yarn tubes 26, incompletely unwound yarn tubes 6', and yarn tubes 26' with unusable yarn remnants still wound thereabout, which are ejected from the winding stations 5 along the transverse transport paths 25.

As those persons skilled in the art will recognize and understand, it is known to arrange a bobbin winding machine, such as the machine 1, and a textile yarn spinning machine, which produces fully-wound yarn tubes 6, closely adjacent one another in a textile yarn processing mill and to provide a common or integrated conveyor or other tube transport system for servicing both the winding and spinning machines. It is also known, alternatively, in combined bobbin winding and spinning machine arrangements to provide such a conveyor or other transport system extending about only the winding machine with suitable mechanisms or devices at the head end of the winding machine facing or adjacent the spinning machine for transferring wound and empty yarn tubes between the winding and spinning machines. However, it is unimportant under the present invention whether the transport system serves to transport peg trays 7 and their supported wound and empty yarn tubes 6,26, in a transport loop extending about both the winding machine 1 and an associated spinning machine or, alternatively, whether the transport loop of the transport system extends only about the winding machine 1 with tube transfer mechanisms being arranged at the head end shown of the winding machine 1. Accordingly, the terminal ends of the transport conveyors 9,11 are not shown in FIG. 1, to indicate that the present invention may be embodied in a winding machine utilizing a transport system of either of the afore-described type.

The winding machine 1 is equipped with an end frame structure 2 at a head end of the winding machine 1, i.e., the end which would be arranged facing or adjacent an associated spinning machine, which end frame structure 2 typically houses common supply devices or mechanisms for all of the winding stations 5, as aforementioned. According to the present invention, a portion of the end frame structure 2 is elevated with respect to the transport paths 8,11, the lower extent of the elevated portion being defined by a base plate 3, to define a passageway 4 within the overall floor space occupied by the end frame structure 2 through which peg trays 7 supporting tubes 6' or 26' with residual or remnant yarn remaining thereon may be transferred from the transport path 11 back to the transport path 8. Specifically, the present invention provides transport paths 13,14,15,16 along with a tube cleaning device 17 and a yarn end preparation device 18 directly beneath the elevated base plate 3 of the end frame structure 2.

The transport path 16 is preferably formed by a conveyor belt extending through the passageway 4 and driven in the direction of the arrow as shown in FIG. 1 to travel transversely through the passageway 4 from the transport path 11 to the transport path 8. The transport path 13 is likewise preferably formed by a conveyor belt driven to travel through the passageway 4 in the opposite direction transversely from the transport path 8 to the transport path 11. The tube cleaning device 17, only schematically shown in FIG. 1, may be of any suitable construction adapted to remove residual unusable yarn windings remaining on a yarn tube, e.g., tubes 26'. The yarn end preparation device 18, also only schematically shown in FIG. 1, may be of any suitable construction adapted to locate and free the leading end of a residual quantity of usable yarn windings remaining on a partially unwound yarn tube, e.g., tube 6', to ready the tube for resumption of unwinding operation. The tube cleaning device 17 and the yarn end preparation device 18 are located within the passageway 4 beneath the end frame base plate 3 laterally between the transport paths 13,16. The secondary transport path 15 is arranged to travel transversely from the transport path 16 to the transport path 13 through or alongside the tube cleaning device 17 to deliver tubes 26' with unusable winding remnants thereon to the tube cleaning device 17. The secondary transport path 14 is similarly arranged to deliver tubes 6' having residual usable yarn windings thereon from the transport path 16 to the yarn end preparation device 18 and then to return prepared tubes 6' back to the transport path 16. For this purpose, the transport path 14 may be in the form of a reversible conveyor.

Suitable sensors and shunts (not shown) are provided at the junctions between the transport paths, e.g., between the main transport path 11 and the secondary path 16, between the secondary transport paths 16 and 15, and between the secondary transport paths 16 and 14, to detect and differentiate empty tubes 26, remnant tubes 26', and residual yarn tubes 6', from one another and to divert, by means of the shunts, residual and remnant tubes 6',26' from the main transport path 11 to the secondary path 16 and therefrom to the appropriate secondary path 14 or 15 and the tube cleaning or yarn end preparation devices 17,18 associated therewith. More specifically, empty yarn tubes 26 continue to travel along the transport path 11 for return to a spinning machine, while tubes 26' with remnant yarn thereon are shunted to the tube cleaning device 17 for remnant removal and yarn tubes 6' with residual yarn are shunted to the end preparation device 18 for location and preparation of the leading end of such yarn. Throughout such handling, the yarn tubes continue to be carried on respective peg trays or pallets 7. After removal of remnant yarn from a tube 26', the tube and its supporting peg tray 7 are delivered onto the secondary transport path 13 which returns the tube and peg tray assembly to the main transport path 11 for transport to a spinning machine. On the other hand, residual yarn tubes 6', after end preparation by the device 18, are returned with their peg trays 7 to the secondary transport path 16 and therefrom are returned to the main transport path 8 for re-delivery to one of the winding stations 5.

As will be recognized by those persons skilled in the art, the centralized or common tube handling devices, such as a tube cleaning device 17 and/or a yarn end preparation device 18, which are generally considered to be necessary or at least desirable to optimize a winding machine's output and minimize its down time, generally increase significantly the floor space required for a winding machine in the typical conventional design of known winding machines, in particular the conventional design and construction of their end frames. In contrast, the present invention enables a significant savings of floor space by reconfiguring a winding machine's end frame to enable such handling devices to be disposed within the same overall floor space which would otherwise be occupied by the end frame. It is also contemplated to be possible, depending upon the dimensions of the transport paths and the handling devices 17,18, to house additional machine components or units under the base plate 3 of the end frame 2, e.g., additional backup extents of the transport paths.

Figure 2:
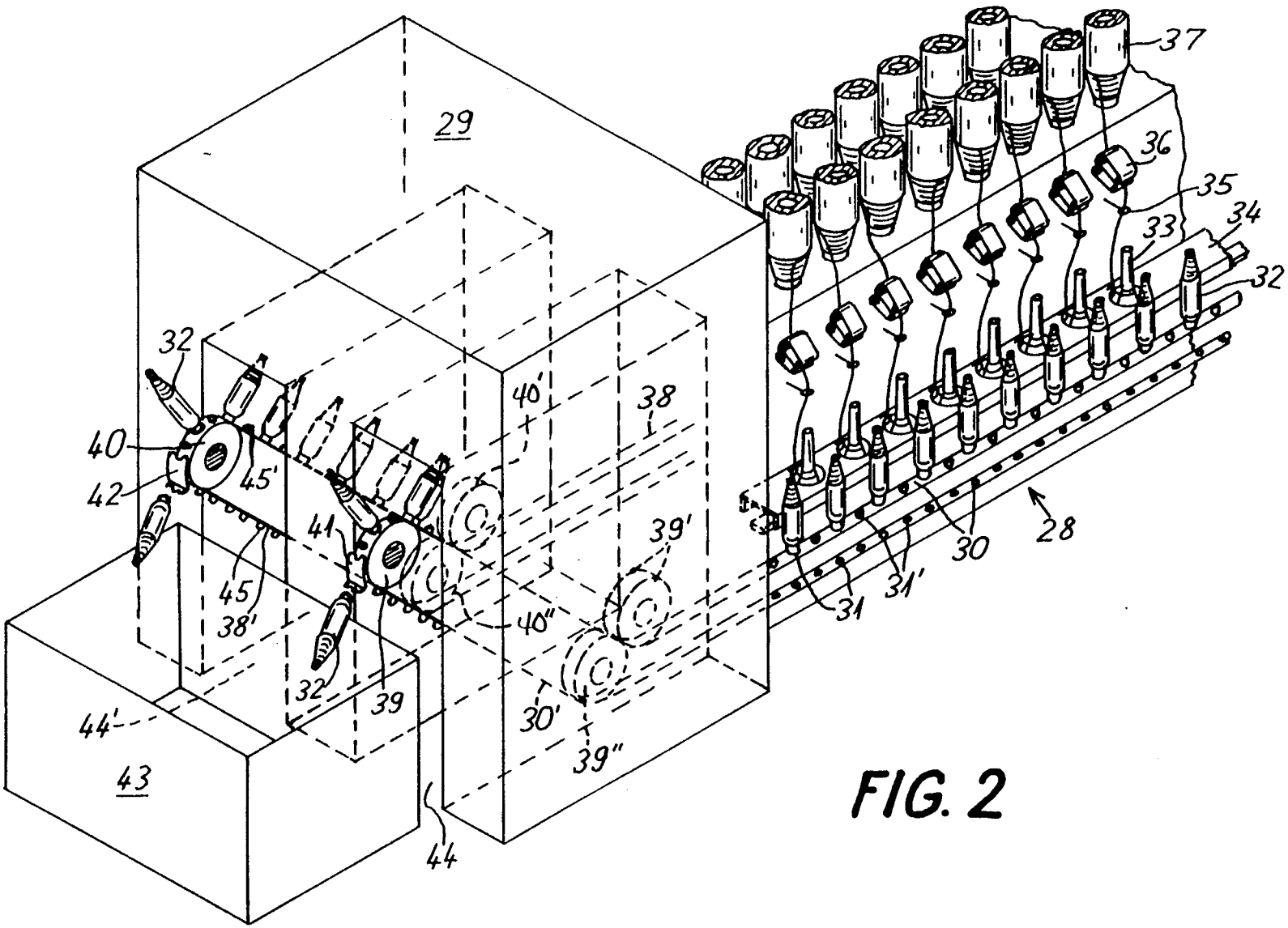
FIG. 2 is a perspective view of a multi-station textile ring spinning machine equipped with conveyor belts extending along the machine spindles at each opposite longitudinal side thereof for carrying spinning bobbins on support pins spaced along the length of the conveyor belts, according to another preferred embodiment of the present invention.

FIG. 2 illustrates another embodiment of the present invention in a ring spinning machine of the type having a plurality of spinning stations arranged in adjacent alignment to one another along the length of the machine. As shown, at each spinning station, roving from a flier frame bobbin 37, or other suitable package, is delivered to a set of drafting rollers 36, or other suitable drafting device, from which yarn drawn from the roving is directed through a yarn guide 35 to a ring traveler on a vertically-reciprocating, longitudinally-extending ring rail 34 which applies the drawn yarn to the periphery of a yarn tube or bobbin 33 supported on a driven spinning spindle for winding of the yarn thereabout in a cop-type fashion. In this manner, the roving is drafted to a desired fineness, i.e., to a desired yarn count and is twisted by the action of the ring traveler as the yarn is wound onto the yarn tube 33. Common drive mechanisms (not shown) are provided for driving the plural spinning spindles, the reciprocating motion of the ring rail 34, and the drafting devices 36, and may typically be housed within the end frame structure 29, as well as any other customary central or common supply mechanisms or devices of the spinning machine.

A conveyor belt 30 extends the length of the spinning machine alongside the spinning spindles and has a plurality of support pins 31 affixed thereto at spacings corresponding to the spacings of the spindles. Additional mounting pins 31' are affixed to the conveyor belt 30 intermediate the mounting pins 31. In this manner, empty spinning tubes may be transported to the spinning stations on the mounting pins 31' of the conveyor belt 30 to replace active yarn tubes on the machine spindles when fully-wound, which may be placed onto the mounting pins 31 upon removal. An automatic tube doffing and donning apparatus or other appropriate tube exchange machine or mechanism may be provided for automatically accomplishing such a tube exchange operation.

After a tube exchange operation, the conveyor belt 30, now carrying on the pins 31 fully-wound yarn tubes doffed from the spinning spindles, represented in FIG. 2 by the yarn tubes 32, delivers the doffed yarn tubes 32 to the head end of the spinning machine 28 (shown in FIG. 2) for deposit into an appropriate storage container 43 or, alternatively, for delivery to an interrelated transport system of an associated bobbin winding machine. The spinning machine 28 as shown is a customary doublesided spinning machine, i.e., having a plurality of aligned spinning stations along each opposite longitudinal side of the machine. Thus, another conveyor belt 38 with spaced mounting pins 45,45' of substantially identical construction to the conveyor belt 30, is arranged at the opposite side of the spinning machine 28.

According to the present invention, an end frame structure 29 at one longitudinal end of the spinning machine 28 is constructed to define passageways 44,44' in parallel relation through the longitudinal extent of the end frame structure 29 in alignment with the conveyor belts 30,38. Each conveyor belt 30,38 is deflected by a set of guide rollers to constrain the belts 30,38 to travel through the respective passageways 44,44' along belt sections 30',38' at an obliquely upward angle to the main extent of each belt along the spinning stations of the spinning machine 28. For example, as shown in FIG. 2, the conveyor belt 30 is thusly guided by a pair of deflection rollers 39',39'' arranged at the entrance to the passageway 44 and an upwardly disposed deflection roller 39 at the outward end of the passageway 44. The deflection roller 39'' is preferably disposed between the upper and lower runs of the endless conveyor 30, while the deflection roller 39' engages the upwardly facing surface of the upper run of the conveyor 30. Necessarily, therefore, the upper deflection roller 39' is disposed laterally to one longitudinal side of the belt 30 to avoid interference with the mounting pins 31,31' and yarn tubes carried thereon. As necessary or desirable, a pair of such deflection rollers 39' may optionally be arranged coaxially to engage both opposite longitudinal sides of the conveyor belt 30. The conveyor belt 38 is correspondingly deflected and guided by a set of deflection rollers 40,40',40''.

At the terminal end of the upper run of each conveyor belt 30,38 at the location of the respective deflection rollers 39,40, a respective tube doffing plate 41,42 of a wedge-shaped configuration is arranged to engage and lift the base of each fully-wound yarn tube 32 from the respective mounting pin 31,45 on which supported to direct the tubes 32 to fall gravitationally into the collection container 43.

As will be understood, the oblique upwardly angled conveyor sections 30',38' may be eliminated, for example, if the spinning machine 28 is directly connected in association with a bobbin winding machine so that the tubes 32 are to be transferred directly to a conveyor system for the winding machine, e.g., by a known transfer mechanism or the like. In such case, the passageways 44,44' through the end frame structure 32 may be formed to a correspondingly lesser elevation which, in turn, provides additional interior space within the end frame structure 29 for the central common machine devices or mechanisms.

It is also contemplated within the scope of the present invention to configure a textile machine's end frame structure with an elevated overhanging or cantilevered portion to define therebeneath a bobbin transport passageway, which would still provide the same advantages as above-discussed of arranging the componentry of the end frame structure and a bobbin transport path without increasing the overall floor space required for the end frame structure. Further, it is to be understood that the invention is not restricted to machines which produce, handle or transport cop-wound yarn tubes but may also include machines handling other strand-supporting bobbins or tubes of other dimensions and formations, e.g., cross-wound bobbins.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An automatic textile strand handling machine comprising a plurality of work stations arranged adjacent one another, each said work station having respective operation devices for performing strand handling operations with respect to a strand bobbin, means for transporting strand bobbins relative to said work stations, housing means occupying a predetermined plan area at one end of said work stations for enclosing supply means for supplying common operational power inputs to said operating devices of all said work stations, said housing means comprising at least one passageway for transport of strand bobbins through the plan area occupied by said housing means, and at least one means for performing a strand processing operation with resect to the strands of strand bobbins, said bobbin processing means being arranged within the plan area occupied by said housing means for operation on strand bobbins transported through said at least one passageway.

2. An automatic textile strand handling machine according to claim 1 and characterized further in that said housing means comprises a base portion defining an upper limit of said passageway sufficient to accommodate unrestricted transport therethrough of strand bobbins.

3. An automatic textile strand handling machine according to claim 1 and characterized further in that said passageway is configured and dimensioned to permit manual access by a machine operator to strand bobbins on the path of bobbin transport through said at least one passageway.

4. An automatic textile strand handling machine according to claim 1 and characterized further in that said passageway is configured and dimensioned to permit manual access by a machine operator to said bobbin processing means through said at least one passageway.

5. An automatic textile strand handling machine comprising a plurality of work stations arranged adjacent one another, each said work station having respective operation devices for performing strand handling operations with respect to a strand bobbin, means for transporting strand bobbins relative to said work stations, housing means occupying a predetermined plan area at one end of said work stations for enclosing supply means for supplying common operational power inputs to said operating devices of all said work stations, said housing means comprising at lest one passageway for transport of strand bobbins through the plan area occupied by said housing means, said bobbin transporting means defining a transport path having a first section extending along said work stations and a second section extending through said passageway, said bobbin transporting means being configured for transporting strand bobbins by means of individual support members, and means for performing a bobbin handling operation arranged along said second transport path section and said housing means, said performing means being disposed above said bobbin handling means and said second transport path sections.

6. An automatic textile strand handling machine according to claim 5 and characterized further in that said bobbin handling means comprises means for preparing a leading strand end on a bobbin for unwinding therefrom.

7. An automatic textile strand handling machine according to claim 5 and characterized further in that said bobbin handling means comprises means for removing residual strand from a bobbin.

8. An automatic textile strand handling machine comprising a plurality of work stations arranged adjacent one another, each said work station having respective operating devices for performing strand handling operations with respect to a strand bobbin, means for transporting strand bobbins relative to said work stations, and housing means at one end of said work stations for enclosing supply means for supplying a common operational power input to said operating devices of all said work stations, said housing means comprising at least one passageway for transport of strand bobbins through the plan area occupied by said housing means and means arranged within the plan area occupied by said housing means for performing at least one of a bobbin cleaning operation and a strand end preparation operation on strand bobbins during transportation through said at least one passageway.

* * * * *